US008025100B2

(12) United States Patent
Dehaene et al.

(10) Patent No.: US 8,025,100 B2
(45) Date of Patent: Sep. 27, 2011

(54) METHOD AND DEVICE FOR COMPRESSING A MULTIPHASE FLUID

(75) Inventors: Pierre-Louis Dehaene, Bizanos (FR); Jean-Louis Beauquin, Saint-Faust (FR)

(73) Assignee: Total S.A., Courbevoie (FR)

( * ) Notice: Subject to any disclaimer, the term of this patent is extended or adjusted under 35 U.S.C. 154(b) by 981 days.

(21) Appl. No.: 11/688,700

(22) Filed: Mar. 20, 2007

(65) Prior Publication Data

US 2007/0227969 A1 Oct. 4, 2007

(30) Foreign Application Priority Data

Mar. 30, 2006 (FR) ..... 06 02756

(51) Int. Cl.
*B01D 50/00* (2006.01)

(52) U.S. Cl. ..... 166/265; 96/194; 166/267

(58) Field of Classification Search ..... 95/156, 95/39, 241, 242, 247, 248, 266; 96/155, 96/193, 194, 204, 206; 166/265, 267
See application file for complete search history.

(56) References Cited

U.S. PATENT DOCUMENTS 4,506,735 A * 3/1985 Chaudot ..... 166/357
5,526,684 A 6/1996 Liu et al.
2003/0005823 A1* 1/2003 Le Blanc et al. ..... 95/149
2007/0029091 A1 2/2007 Stinessen et al.
2009/0211763 A1* 8/2009 Fowler et al. ..... 166/357

FOREIGN PATENT DOCUMENTS

| | | | |
|---|---|---|---|
| GB | 2203062 | A | 10/1988 |
| GB | 2337561 | A | 11/1999 |
| GB | 2355214 | A | 4/2001 |
| GB | 2399864 | A | 9/2004 |
| GB | 2418213 | A | 3/2006 |
| WO | 0120128 | A1 | 3/2001 |
| WO | 02092965 | A1 | 11/2002 |
| WO | 2004083601 | A1 | 9/2004 |
| WO | 2005094961 | A1 | 10/2005 |
| WO | 2006010765 | A1 | 2/2006 |
| WO | 2006132541 | A1 | 12/2006 |

OTHER PUBLICATIONS

Search Report, May 5, 2007, UK Intellectual Property Office, Application No. GB0705896.9.

* cited by examiner

*Primary Examiner* — Duane Smith
*Assistant Examiner* — Tiffany N Palmer
(74) *Attorney, Agent, or Firm* — Lesley S. Craig

(57) ABSTRACT

The invention relates to a method for increasing the pressure of a liquid/gas multiphase fluid, and a method for compressing a gaseous fluid, comprising:
(b1) entrainment of the gaseous fluid using a motive liquid, to obtain a pressurized mixture of gas and motive liquid;
(b2) separation of the pressurized mixture obtained in the preceding step in order to obtain, on the one hand, a compressed gas, and on the other hand, an auxiliary liquid.
The invention further relates to devices for this purpose. Application to the production of hydrocarbons.

14 Claims, 4 Drawing Sheets

METHOD AND DEVICE FOR COMPRESSING A MULTIPHASE FLUID

TECHNICAL FIELD

The invention relates to a method for compressing a multiphase fluid, and a device for implementing same. The invention is more particularly for use in connection with hydrocarbon production, particularly offshore.

TECHNICAL BACKGROUND

In a conventional hydrocarbon production installation, particularly offshore, the natural hydrocarbon reservoir is located in the subsoil. It consists of a volume of porous rock mainly comprising hydrocarbons in the gas and/or liquid state, and salt water. One or more wells are drilled to convey the fluids from the reservoir to the surface installations.

Hydrocarbon production is said to be flowing when the fluid pressure is sufficiently high within the reservoir to make the fluid rise naturally in the well and make the effluents reach the surface production units. However, in most cases, the flowing feature is absent, at least during part of the production period, particularly at the end of production. It is then necessary to artificially compress the fluids to make them rise to the surface and to operate at a requisite pressure.

In fact, conventional means for raising the pressure are only suitable for dealing with a single-phase fluid, that is, a gas or a liquid, but they are not suitable for dealing with a multiphase fluid, such as a petroleum effluent. Thus, pumps are known capable of raising the pressure of a gas-free liquid, and compressors are known capable of raising the pressure of a liquid-free gas.

In order to raise the pressure of a multiphase fluid of the petroleum effluent type, it is therefore necessary to separate the liquid and gas phases prior to their treatment, by a pump and a compressor respectively. Conventionally, the phases are separated using a tank or vessel, that is, a large volume unit in which the gas and liquid are separated by gravity. However, the operating pressure in a system of this type remains limited due to the large volume of a separation tank: this is because working at high pressure implies designing a tank with a very thick wall. This conventional system also has a number of drawbacks in terms of size and safety. It is particularly indispensable to provide safety depressurization means such as valves, vents or flares.

Other existing systems are installations called "WELLCOM" by CALTec which provide a compression of the hydrocarbon effluents issuing from low pressure wells using hydrocarbon effluents issuing from high pressure wells and achieve this in jet pumps or ejectors. A separation in a compact separator is provided in the case in which the effluents are multiphase, in order to compress the liquid with the liquid on the one hand, and, optionally, the gas with the gas on the other hand. If a high pressure well is lacking, the liquid portion can be compressed before serving in its turn to increase the pressure of the gas portion in a jet pump.

Document SPE 48934 (Carvalho et al., SPE Annual Technical Conference and Exhibition, September 1998) describes the combination of an electric submersible pump (ESP) and a jet pump in a hydrocarbon well. The ESP compresses the liquid hydrocarbons, and the gaseous hydrocarbons are entrained by the compressed liquid hydrocarbons using the jet pump.

Furthermore, document WO 2006/010765 describes a system comprising an "in line" separator upstream of distinct compressors for the gas, oil and water. The fluid residence time in the separator is short, so that this system is unsuitable for operation in slug flow conditions.

Another drawback of some of the abovementioned systems is associated with the mechanical transmission which is positioned on either side of the chamber walls, to apply forces to the fluids, said transmission raising a potential safety problem.

Besides these separate compression systems, other devices exist for raising the pressure of a multiphase fluid without separating the fluid phases. These include multiphase pumps. However, these devices remain complex and costly. This is because they require inlet fluid pretreatments to guarantee a minimum proportion of liquid, as well as cooling equipment, which accordingly demand safety equipment. They involve bulky, massive technologies, whose implementation entails a large scale design and manufacturing process. Their use also demands complex maintenance. They further often comprise rotating seals (mechanical seals), which are potential sources of gas leakage.

A need therefore exists for a method and a device for easy implementation thereof, for compressing a multiphase fluid to a high pressure, and which does not have the abovementioned drawbacks. In particular, a need exists to be able to adapt the capacity of the device to the evolution of the reservoir.

SUMMARY OF THE INVENTION

The invention relates to a method for increasing the pressure of a liquid/gas multiphase fluid, comprising the following steps:

(a) in a first module, separation of a liquid/gas multiphase fluid in order to obtain a liquid fraction and a gas fraction, and compression of said liquid fraction to obtain a compressed liquid fraction;

(b) in a second module, compression of the gas fraction obtained in step (a), to obtain a compressed gas fraction;

in which step (b) comprises the following substeps:

(b1) entrainment of the gas fraction obtained in step (a) using a motive liquid, to obtain a pressurized mixture of gas fraction and motive liquid;

(b2) separation of the pressurized mixture obtained in the preceding step to obtain, on the one hand, a compressed gas fraction and, on the other hand, an auxiliary liquid.

According to one embodiment, the separation in step (a) and the separation in step (b2) take place at least partially, and preferably substantially totally, in vertical or inclined pipes.

According to one embodiment, the separation in step (a) and the separation in step (b2) take place at least partially, and preferably substantially totally, in dummy wells.

According to one embodiment, the method further comprises the following substep:

(b3) compression of the auxiliary liquid obtained in step (b2) to supply the motive liquid of step (b1).

According to one embodiment, the compression of the liquid fraction in step (a) and/or the compression of the auxiliary liquid in step (b3) take place with submersible pumping means.

According to one embodiment, step (a) is preceded by a step of pre-separation of the liquid/gas multiphase fluid.

According to one embodiment, each separation includes a dynamic separation carried out at least partly by centrifugal action.

According to one embodiment, in the inventive method:

the gas fraction obtained in step (a) is at a pressure of between 0 and 200 bar absolute;

the compressed gas fraction obtained in step (b) is at a pressure of between 1 and 500 bar absolute.

According to one embodiment, the compressed liquid fraction obtained in step (a) is at a pressure of between 1 and 500 bar absolute.

According to one embodiment, the motive liquid is at a pressure of between 10 and 600 bar absolute.

According to one embodiment, the multiphase fluid is initially at a pressure of between 0 and 200 bar absolute.

According to one embodiment, the steps (a), (b1), (b2) and optionally (b3) are carried out at a temperature of between 5 and 350° C.

According to one embodiment, the multiphase fluid may flow in slug flow conditions.

According to one embodiment, the liquid comprised in the liquid/gas multiphase fluid is an emulsion.

According to one embodiment, the inventive method further comprises the following step:

(d) combination of the compressed liquid fraction obtained in step (a) with the compressed gas fraction obtained in step (b) to obtain a compressed multiphase fluid.

The invention further relates to a method for compressing a gaseous fluid comprising:

(b1) the entrainment of the gaseous fluid using a motive liquid, to obtain a pressurized mixture of gas and motive liquid;

(b2) separation of the pressurized mixture obtained in the preceding step in order to obtain, on the one hand, a compressed gas and, on the other hand, an auxiliary liquid;

in which the separation of step (b2) takes place at least partially, and preferably substantially totally, in a dummy well.

According to one embodiment, the inventive method further comprises the following substep:

(b3) compression of the auxiliary liquid obtained in step (b2) to supply the motive liquid of step (b1).

According to one embodiment, the compression of the auxiliary liquid in step (b3) takes place with submersible pumping means.

According to one embodiment, the separation includes a dynamic separation carried out at least partly by centrifugal action.

According to one embodiment, the compressed gas fraction obtained in step (b2) is at a pressure of between 1 and 500 bar absolute.

According to one embodiment, the motive liquid is at a pressure of between 10 and 600 bar absolute.

According to one embodiment, the gaseous fluid is initially at a pressure of between 0 and 200 bar absolute.

According to one embodiment, the steps (b1), (b2), and optionally (b3) are carried out at a temperature of between 5 and 350° C.

Advantageously, the multiphase or gaseous fluid treated in the inventive methods is a hydrocarbon effluent.

According to one embodiment, the gas fraction of the multiphase fluid or the gaseous fluid contains $H_2S$ and/or $CO_2$.

The invention further relates to a hydrocarbon production method, comprising the following steps:

withdrawal of a liquid/gas multiphase fluid issuing from a hydrocarbon reservoir, in which the liquid is an emulsion;

increasing the pressure of said multiphase fluid by the inventive method, in order to obtain a compressed multiphase hydrocarbon fluid.

According to one embodiment, said hydrocarbon reservoir is a subsea reservoir.

According to one embodiment, the method subsequently comprises the additional step of:

separation of the compressed multiphase hydrocarbon fluid into a liquid portion and a gas portion.

According to one embodiment, the method subsequently comprises the additional step of:

separation of the liquid portion into liquid hydrocarbons on the one hand and water on the other hand.

According to one embodiment, the gas fraction of the multiphase fluid or the gaseous fluid contains $H_2S$ and/or $CO_2$.

The invention further relates to a device for compressing a liquid/gas multiphase fluid, comprising:

at least one first module comprising:

a first liquid separation and compression unit (20);

at least one second module comprising:

an ejector (33);

a separator (34) connected to the outlet of the ejector (33);

a motive liquid intake line (32) connected to the inlet of the ejector (33);

a compressed gas fraction intake line (25) and an auxiliary liquid intake line (24) connected to the outlet of the separator (34);

at least one liquid/gas multiphase fluid intake line (11) feeding the first module;

at least one compressed liquid fraction withdrawal line (21) at the outlet of the first module;

at least one gas fraction withdrawal line (22) connecting an outlet of the first liquid separation and compression unit (20) of the first module to an inlet of the ejector (33) of the second module; and at least one compressed gas fraction withdrawal line (31) at the outlet of the second module.

According to one embodiment, the first liquid separation and compression unit (20) and the second liquid separation and compression unit (30) are vertical or inclined pipes.

According to one embodiment, the first liquid separation and compression unit (20) and the second liquid separation and compression unit (30) are dummy wells.

According to one embodiment, the first liquid separation and compression unit (20) is equipped with submersible pumping means (26) and the second liquid separation and compression unit (30) is equipped with submersible pumping means (38).

According to one embodiment, the submersible pumping means (38) compress the auxiliary liquid into motive liquid.

According to one embodiment, the second module further comprises:

a second liquid separation and compression unit (30), connected to the inlet of the compressed gas fraction intake line (25) and to the auxiliary liquid intake line (24), and connected to the outlet of the compressed gas fraction withdrawal line (31) and to the motive liquid intake line (32).

According to one embodiment, the first module further comprises:

a separator (12) whereof the inlet is connected to the multiphase fluid intake line (11);

a gas pre-fraction intake line (13) connecting an outlet of the separator (12) to an inlet of the first liquid separation and compression unit (20);

a liquid pre-fraction intake line (14) connecting an outlet of the separator (12) to an inlet of the first liquid separation and compression unit (20).

According to one embodiment, the inventive device further comprises:

at the inlet of the second module, an auxiliary liquid reserve intake line (35) connected to the inlet of the second liquid separation and compression unit (30); and from the second module to the first module, a transfer line (36) connecting an outlet of the second liquid separation and compression unit (30) to an inlet of the first liquid separation and compression unit (20).

According to one embodiment, the multiphase fluid intake line (41) feeds a plurality of first modules (43*a*, 43*b*) and each of the first modules (43*a*, 43*b*) feeds a gas fraction to a plurality of second modules (47*a*, 47*b*, 47*c*, 47*d*).

The invention further relates to a gas compression device comprising:

an ejector (33);

a gas feed line (22) connected to the inlet of the ejector (33);

a separator (34) connected to the outlet of the ejector (33);

a liquid separation and compression unit (30) consisting of a dummy well;

a compressed gas intake line (25) and an auxiliary liquid intake line (24) connected to the outlet of the separator (34) and to the inlet of the liquid separation and compression unit (30);

a compressed gas withdrawal line (31) at the outlet of the liquid separation and compression unit (30); and a motive liquid intake line (32) connected to the outlet of the liquid separation and compression unit (30) and to the inlet of the ejector (33).

According to one embodiment, the liquid separation and compression unit (30) is equipped with submersible pumping means (38).

According to one embodiment, the submersible pumping means (38) compress the auxiliary liquid into motive liquid.

According to one embodiment, the device further comprises:

at the inlet of the module (30), an auxiliary liquid reserve intake line (35) connected to the inlet of the second liquid separation and compression unit (30).

The invention further relates to a device for producing pressurized hydrocarbons comprising:

an inventive device as previously described; and a hydrocarbon drilling/production installation (40) supplying same.

The invention serves to overcome the abovementioned inadequacies and drawbacks of the known techniques.

The invention particularly has one or more of the following advantageous features over existing solutions:

According to some embodiments, the maximum operating pressure withstood may be very high (for example, above 200 bar), which is particularly advantageous in the case of subsea applications.

The inventive method and device are robust and safe; they require neither safety valve nor rapid decompression systems; according to some embodiments, the safety of the system is particularly favored by the immersion of the pumps and hence the absence of transmission of mechanical loads across the walls, thereby serving to contain the fluids in a properly closed chamber, only the electric cables passing through the walls thereof; the system also has a small hydrocarbon inventory on the surface.

The inventive method and device serve to minimize the size of the installation, and this is particularly advantageous in the context of offshore production.

The inventive method and device are of the modular type, implying the possibility of adjusting the pumping and compression capacities over time according to the needs generated by the reservoirs. Each module used in the context of the invention can also evolve or be optimized independently of the others.

The inventive method and device are particularly suitable for treating multiphase fluid in slug flow conditions, that is, alternating mainly liquid pockets and mainly gaseous pockets.

The implementation of the invention requires no large scale lifting means such as a rig, neither for installation nor for maintenance, contrary to systems in which a pump is provided in the well.

The inventive device can better withstand the presence of solids in the incoming fluid, such as grains of sand or pieces of rock.

The inventive device is advantageous in the case of low-power compression, for example, the compression of a well, assistance in the startup of a well or the compression of flare gas.

DETAILED DESCRIPTION OF EMBODIMENTS

The following description illustrates the invention without limiting it. In the following, reference is made to a particular example of a multiphase fluid consisting of liquid and gaseous hydrocarbons, and salt water, in the context of hydrocarbon production, but it is understood that the inventive device and method can be applied to the treatment of other types of multiphase fluids.

Hydrocarbon Compression Device (Also Called Compression Tandem)

Figure 1:
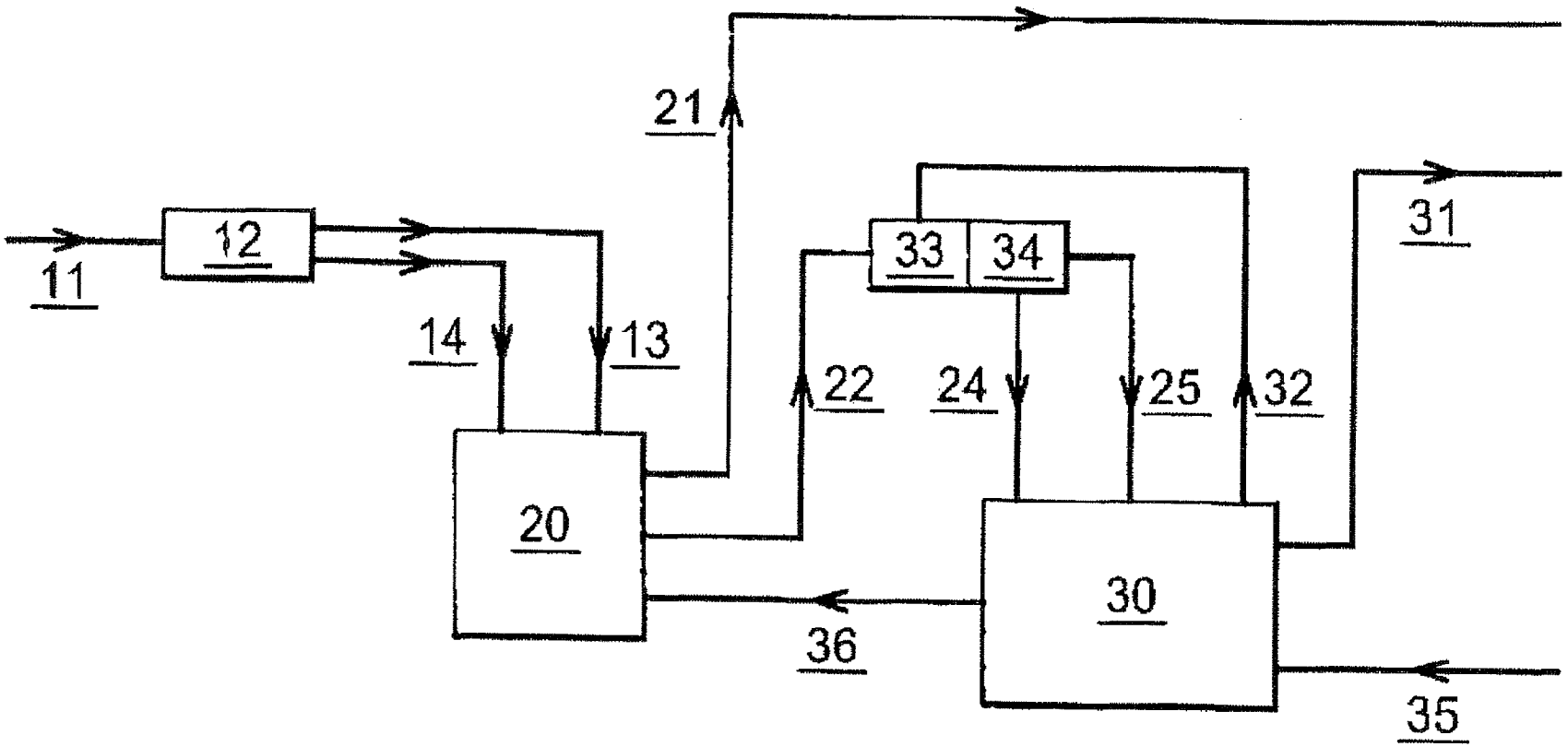
FIG. 1 is a schematic block diagram of an inventive device comprising a first module and a second module.
Figure 3:
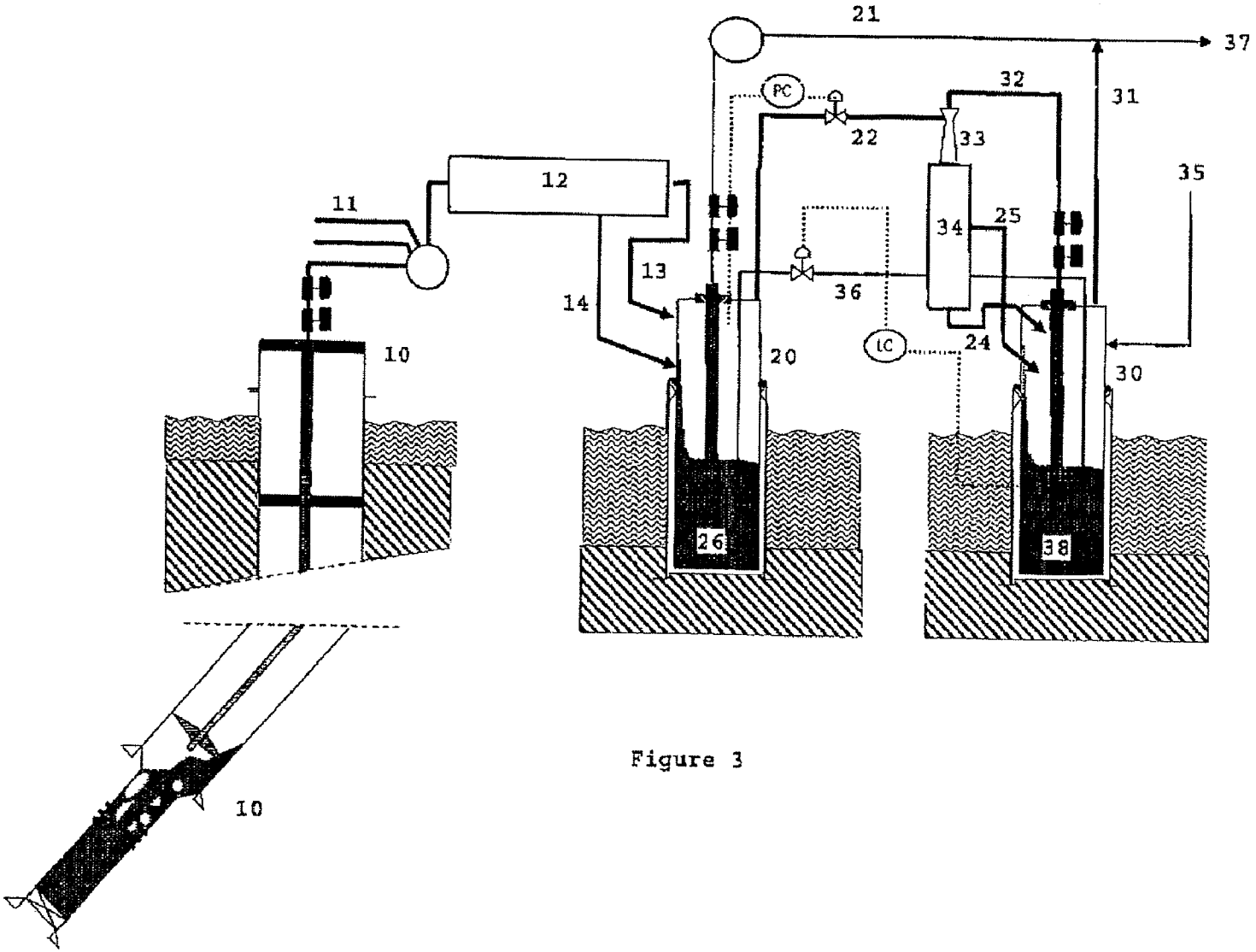
FIG. 3 is a realistic schematic representation of an inventive device comprising a first module and a second module.
Figure 4:
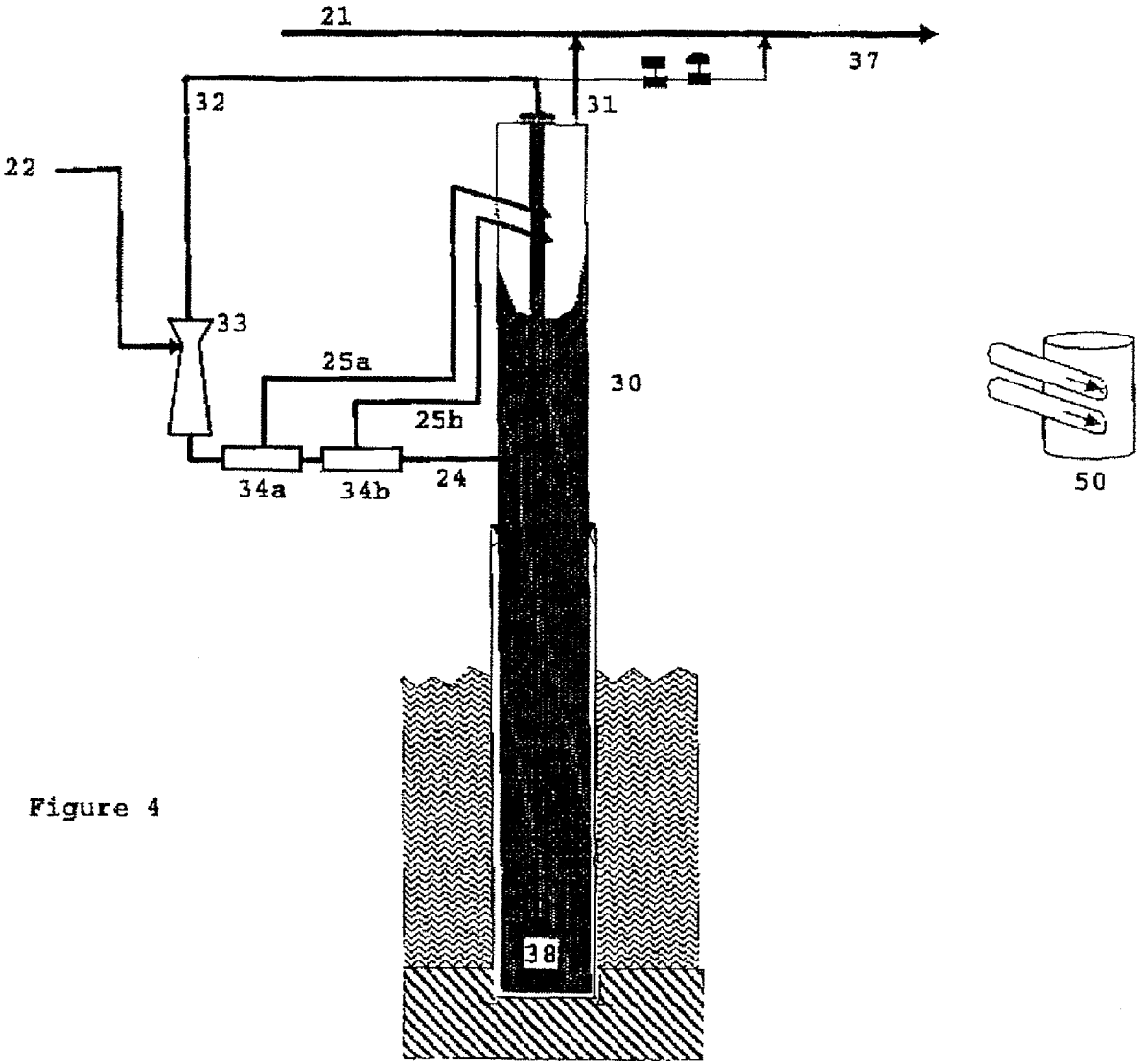
FIG. 4 is a realistic schematic representation of a detail of the inventive device (essentially the second module of the device).

With reference to FIG. 1, FIG. 3 and FIG. 4, a first version of the hydrocarbon compression device of the invention comprises two modules: a first module mainly for separating a liquid fraction and a gas fraction and for compressing the liquid fraction, particularly comprising a liquid separation and compression unit 20; and a second module mainly for compressing the gas fraction, comprising a gas compression unit composed of an ejector 33 and a separation unit 34 and a liquid separation and compression unit 30.

The upstream part of the device shows an intake line 11 of a multiphase fluid issuing from a production unit 10 or optionally from a plurality of production units whereof the effluents are collected and pooled (see FIG. 3). This line is connected to a rough compact separator 12, which belongs to the first module. This separator 12 is of a conventional type. For example, it may comprise a pipe or tube (horizontal or not) equipped with an internal helicoidal compartmentalization which forces the fluid flow and particularly the liquid fraction along the periphery of the pipe or tube, by centrifugal action. Such a helicoidal compartmentalization is provided for example in the Auger system, produced by BP Arco.

At the outlet of the separator 12, two intake lines 13 and 14 respectively of a liquid pre-fraction and a gas pre-fraction supply the liquid separation and compression unit 20. It must be observed that the presence of the separator 12, although advantageous, is optional. It is possible to do without the separator 12 and to make the intake line 11 supply the unit 20 directly.

The unit 20 may comprise static and/or dynamic separation means. "Dynamic separation"means here the separation of a gas phase and a liquid phase from a multiphase fluid taking place using a fluid flow at a certain rate. "Static separation" means here a separation by gravity in which the mass of multiphase fluid remains globally immobile, that is, does not undergo any flow or overall movement. A typical example of "static separation" is that of a gravity separation in a vessel or a tank. In this context, the multiphase fluid is simply stored in a chamber so that the gas is concentrated in the upper part of the chamber and the liquid in the lower part of the chamber.

Preferably, the unit 20 comprises a combination of static and dynamic separation means.

For example, the unit 20 may be a cyclone separator or "dummy well" made from well type pipe elements.

Such a unit comprises means for circulating fluids. Thus, said means may comprise a tangential (or essentially tangential) connection of the multiphase fluid and/or gas and liquid pre-fraction intake line(s). Thus, the intake line(s) is(are) connected to the wall of the tube or pipe of the unit 20 in a direction tangent or virtually tangent to said wall (according to a Euclidian definition). Moreover, if one now takes a position in the vertical plane, the intake line(s) preferably has/have a certain inclination to the horizontal (for example 20 to 30°). An example of a tangential connection is shown in detail in FIG. 4 at 50.

The tangential connection means provide a fluid injection that is substantially tangential to the wall of the pipe or tube, so as to cause the fluid to flow against said wall, by the action of the centrifugal force. The fluid thus tends to be divided into a liquid fraction and a gas fraction; the liquid fraction tends to fall into the lower part of the pipe or tube along the wall (or periphery) following a helicoidal path about the axis of the pipe or tube, while the gas fraction tends to occupy the central part of the pipe or tube and to rise into the upper part thereof. The centrifugal force applied to the liquid fraction along its helicoidal path serves to optimize the separation of the liquid and the gas. Dynamic separation means as defined above are described in greater detail for example in document U.S. Pat. No. 5,526,684.

The unit 20 may further comprise an internal jacket or wall of concave revolution, fixed or mobile about a central axis, of the conical, cylindrical or helicoidal type, on which the multiphase fluid flows. When the internal jacket is mobile, the friction associated with dynamic separation is reduced.

Furthermore, within such a unit 20 of the dummy well type, a static separation also takes place, because of the large liquid holdup capacity at the bottom of the dummy well. This guarantees a long fluid residence time in the unit 20, which is particularly beneficial in slug flow conditions. Thus the system combines the advantages of the two types of separation, static and dynamic.

The unit 20 also comprises liquid compression means. These liquid compression means preferably consist of a submersible pump 26 in the liquid fraction accumulated by gravity in the bottom part of the unit 20. The pump may be of the "canned" or ESP (electric submersible pump) type. Thus, according to this embodiment, the liquid compression in the unit 20 does not require any mechanical transmission through the wall of the unit 20, but only an electric power transmission, which poses fewer problems from the standpoint of the isolation of the interior of the unit 20 from the exterior.

The pump 26 is suitable for sending the liquid fraction at high pressure into a compressed liquid fraction withdrawal line 21. At the outlet of the unit 20, a gas fraction withdrawal line 22 is also connected. This line 22 may simply be connected to the upper part of the dummy well.

The gas fraction withdrawal line 22 connects the unit 20 to an ejector 33. The ejector 33 is also supplied by a motive liquid intake line 32. The motive liquid and gas fraction are combined in the ejector, in order to supply a compressed mixture. At the ejector 33 outlet, a rough liquid/gas separator 34 is placed. The ejector 33 may be of the "jet ejector" type. It has advantages associated with the absence of moving parts and more generally, advantages of robustness and ease of operation. The separator 34 is of the dynamic type, optionally of the same type as the separator 12 described above. The separation carried out in the unit 30 described below may, in certain cases, be sufficient and make the installation of the dynamic separator 34 optional.

A compressed gas fraction intake line 25 and an auxiliary liquid intake line 24 (the "auxiliary liquid" is the name given to the motive liquid after its separation from the compressed gas fraction) are connected to the outlet of the separator 34. As shown in FIGS. 1 and 3, these two lines 24, 25 supply a liquid separation and compression unit 30 of which the design is similar to that of the unit 20. In particular, it preferably consists of a dummy well equipped with a pump 38, preferably submersible. It is also possible to provide that the separator 34 consists of several units each having a separation function and each having a design as described above, for example of two units 34*a*, 34*b* as shown more particularly in FIG. 4. In this case, the first unit 34*a* is used to make a first separation between auxiliary liquid fraction and compressed gas fraction. To the outlet of the first unit 34*a* is connected a first compressed gas fraction intake line 25*a* and an intermediate line for making the connection with the second unit 34*b*, which is used to perform a second finer separation between auxiliary liquid fraction and compressed gas fraction. Thus, connected to the outlet of the second unit 34*b* is a second compressed gas fraction intake line 25*b* and the compressed liquid intake line 24, or else another intermediate line in the case in which the separator comprises more than two units. Each of the compressed gas fraction intake lines 25*a*, 25*b* is then connected independently to the inlet of the liquid separation and compression unit 30.

The unit 30 is used, on the one hand, to refine the liquid/gas separation between compressed gas fraction and auxiliary liquid which is initiated in the separator 34 or the series of separators 34*a*, 34*b*, and, on the other hand, to compress the auxiliary liquid to recycle it as motive liquid. A compressed gas fraction withdrawal line 31, and the motive liquid intake line 32 which returns to the ejector 33, are connected to the outlet of the unit 30. In short, means are therefore provided to produce a closed circuit flow of auxiliary liquid/motive liquid between the unit 30, the ejector 33 and the separator 34.

However, a transfer line 36 extending from the unit 30 to the unit 20 is provided to discharge the liquid from the unit 30 to the unit 20 in case of excess liquid in the abovementioned closed circuit. The opening and closing of this transfer line 36 are controlled, for example by a sensor of the liquid level in the unit 30. Furthermore, an auxiliary liquid reserve intake line 35 is connected to the inlet of the unit 30 in order to supply the unit 30 with liquid in case of a shortage of liquid in the abovementioned closed circuit. Process water is generally used for this purpose. The opening and closing of this intake line 35 are controlled, for example by a sensor of the liquid level in the unit 30.

The presence of the transfer line 36 is unnecessary in the case in which the fluids of the lines 21 and 31 are remixed (see below).

Similarly, the presence of the intake line 35 is unnecessary in the case in which the original multiphase fluid flowing in the line 11 is saturated with water.

The valuable products, that is, the compressed liquid fraction and the compressed gas fraction, are recovered at the withdrawal lines 21, 31. These withdrawal lines 21, 31 supply downstream processing units (not shown) where it is possible in particular to provide for recombining the compressed liquid fraction with the compressed gas fraction in order to send the compressed recombined fraction to a downstream processing unit, for example a platform, a ship or a floating unit of the FPSO type (floating production, storage and transfer support).

The inventive device can be fully designed of piping elements. This serves to operate at high pressure (above 200 bar), contrary to a conventional separation device based simply on a tank. This feature makes the inventive device particularly suitable for subsea applications, where the internal and external operating pressures of the units are high.

The vertical or inclined pipes used in the first module and in the second module can be drilled into the soil, placed on the soil or on a seabed. The effective weight of the installation is therefore minimal in the case of use on an oil platform. Also in this case, the volumes of hydrocarbons in place at the surface are minimal. The inventive device may therefore not comprise any safety valve or flare.

Furthermore, the rotating seals (mechanical seals) are located inside the pipes of the device, so that there is no possibility of leakage to the exterior. In this way, the safety of the present device is improved over a conventional device.

The present device also has other improved characteristics with regard to the known devices:

maintenance is easier;

it is unnecessary to provide large scale lifting means for installing the device;

the various parts of the installation are based on proven and robust technologies;

the ground area of the installation is minimized, and in the case of offshore production, little equipment is required at the surface;

the device is quieter than a conventional device;

the device is cooled by seawater;

the device does not vibrate compared to an alternative conventional compression unit, thereby facilitating its use on a platform.

Modular Hydrocarbon Production Device

A second version of the inventive device provides for combining a plurality of first modules as defined above and/or a plurality of second modules as defined above.

Figure 2:
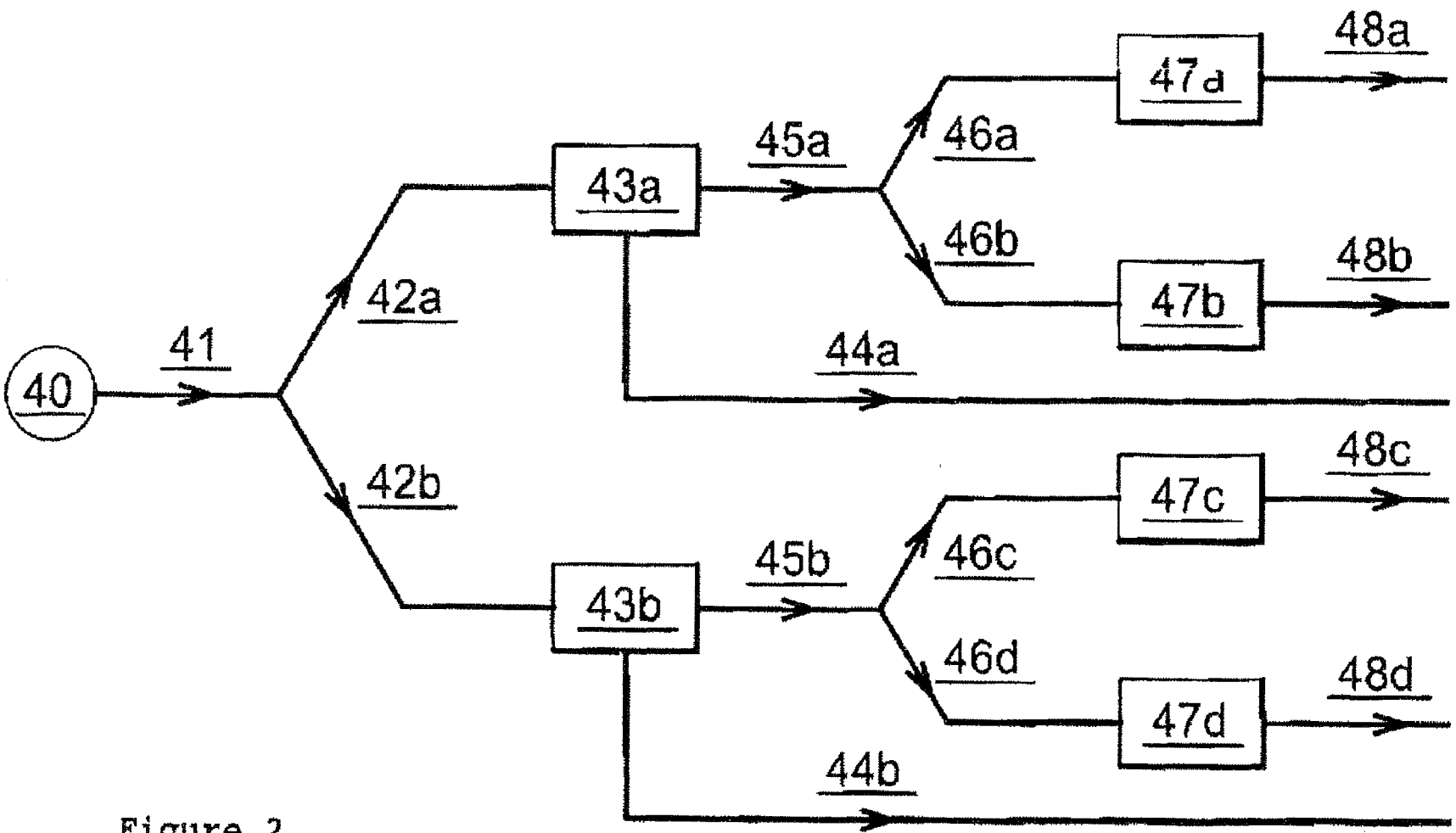
FIG. 2 is a schematic block diagram of an inventive device comprising two first modules and four second modules.

According to a particular embodiment shown in FIG. 2, a single source 40 of multiphase fluid (for example an effluent from a reservoir or a production site) supplies an intake line 41 which is divided into a plurality of secondary intake lines 42*a*, 42*b* whereof two are shown as examples in FIG. 2. Each of the secondary intake lines 42*a*, 42*b* supplies a first respective module 43*a*, 43*b* whereof the design is such as described above. Each first module 43*a*, 43*b* comprises in particular a rough liquid/gas separator (optionally) and a liquid separation and compression unit.

Compressed liquid fraction withdrawal lines 44*a*, 44*b* are provided respectively at the outlet of each first module 43*a*, 43*b* to collect the valuable compressed liquid fraction. At the outlet of each first module 43*a*, 43*b*, a respective gas fraction withdrawal line 45*a*, 45*b* is provided.

Each gas fraction withdrawal line 45*a*, 45*b* is then divided into a plurality of respective branches 46*a*, 46*b*, 46*c*, 46*d*: FIG. 2 shows, by way of example, two branches per gas fraction withdrawal line. Each branch 46*a*, 46*b*, 46*c*, 46*d* supplies in its turn a respective second module 47*a*, 47*b*, 47*c*, 47*d* whereof the design is such as described above. Connected in particular to the outlet of each of the second modules 47*a*, 47*b*, 47*c*, 47*d* is a respective compressed gas fraction withdrawal line 48*a*, 48*b*, 48*c*, 48*d* for collecting the valuable compressed gas fraction.

Downstream of the various withdrawal lines 44*a*, 44*b*, 48*a*, 48*b*, 48*c*, 48*d*, means can be provided for processing the compressed liquid fraction and the compressed gas fraction and, for example, means for recombining the two fractions into a compressed fluid.

It is significant that each module with its equipment is independent, thereby enabling a modular adjustment over time of the pumping and compression capacities according to the needs of the reservoir. It is possible, for example, to add or remove first modules or second modules from the device as required, or to replace one or more modules by one or more modules having different processing capacity. Moreover, the components of each module are conventional, thereby permitting rapid assembly, operation or adaptation of the overall device.

Hydrocarbon Compression Method

Referring again to FIG. 1 and to FIG. 3, an effluent is withdrawn from a source, for example a hydrocarbon reservoir 10. The effluent enters the inventive device via the intake line 11.

This effluent may be composed of liquid and gas. Each of these two components may be present in a proportion of between 0% and 100%; they determine the number of first modules and second modules necessary for the application. Moreover, the liquid portion of the fluid is generally a mixture of water and hydrocarbons, sometimes forming emulsions of the water in oil type or oil in water type. The oil fraction of the liquid may be between 0 and 1. At this stage, the effluent is in the temperature and pressure ranges of between 5° C. and 350° C., and between 0 and 200 bar absolute, for example at a pressure of about 40 bar and at a temperature of about 90° C. The lower pressures may correspond to operations of the well startup, installation or fluid degassing, annulus drainage type, etc. The liquid flow entering the inventive device may be between 1 and 50,000 $m^3$ per day.

The effluent then enters the separator 12 which carries out a rough pre-separation between gas and liquid. A liquid pre-fraction and a gas pre-fraction are recovered at the outlet of the separator 12, and are injected via the lines 13, 14 into the liquid separation and compression unit 20, which is preferably a dummy well. The percentage of gas contained in the "liquid pre-fraction" is lower than 10%. The percentage of liquid contained in the "gas pre-fraction" is lower than 5%. The separation between liquid and gas continues and then progresses in the unit 20. Alternatively, the effluent is injected directly into the unit 20, without pre-separation. The separator 12 is therefore optional.

In both cases, the liquid is entrained by gravity toward the bottom of the dummy well of the unit 20. Preferably, the inlet(s) of the dummy well press the fluids against the inside wall of said dummy well by centrifugal action. This generates a helicoidal, centrifugal or cyclonic movement of said fluids, thereby optimizing the separation into a liquid fraction and a gas fraction. The gas fraction is recovered toward the top of the unit 20 and is withdrawn via the gas fraction withdrawal line 22, while the liquid fraction accumulates in the lower part of the unit 20 where it is used to load the pump 26 which sends the pressurized liquid fraction into the compressed liquid withdrawal line 21. At this stage, the pressure of the liquid fraction at the suction end of the pump is between 0 and 200 bar, for example 40 bar, and at the discharge end of the pump is between 10 and 500 bar, for example 90 bar, said pressure also prevailing in the line 21.

The gas fraction (whereof the pressure is between 0 and 200 bar, for example 40 bar), is then compressed in the second module. The actual gas compression takes place in the ejector 33 by the Venturi tube principle using the motive liquid, which is in the temperature range of from 10 to 120° C. and the pressure range of from 10 to 600 bar, for example 250 bar, or two to three times the pressure of the gas fraction. The motive liquid may be water (for example seawater), a hydrocarbon/water mixture, or any other appropriate fluid. A pressurized mixture of gas fraction and motive liquid is obtained at the outlet of the ejector 33. The gas fraction is then roughly separated from the motive liquid in the separator 24, optionally in a plurality of steps if the separator comprises a plurality of units 34*a*, 34*b*. The liquid at the outlet of the separator 34 is called "auxiliary liquid" to indicate that it is at a lower pressure than that of the motive liquid at the inlet of the ejector 33. The liquid and gas leaving the separator 34 are at the same pressure of between 1 and 500 bar, for example, 90 bar. The separation between liquid and gas then continues and is optionally refined in the liquid separation and compression unit 30, preferably by the same principle as that of the separation in the unit 20. The compressed gas fraction is recovered and collected via the withdrawal line 31. As to the auxiliary liquid, it accumulates in the lower part of the unit 30 where it serves to load the pump 38 (which is preferably completely submerged) which recycles said auxiliary liquid as motive liquid to the ejector 33 while recompressing it to a pressure of between 10 and 600 bar, for example 270 bar.

The compressed gas fraction and the compressed liquid fraction collected in the respective withdrawal lines 31, 21 are in the temperature range of between 5° C. and 350° C, for example 80° C., and the pressure range of between 1 and 500 bar, for example 90 bar. The percentage of gas contained in the "compressed liquid fraction" is generally lower than 10%. The percentage of liquid contained in the "compressed gas fraction" is generally lower than 10%.

The inventive method is ideally suited to operation in slug flow conditions, in which pockets of liquid and gas alternate in the effluent, thanks to the long fluid residence times in the dummy wells. If the gas entering the ejector 33 is saturated with water, a liquid purge via the line 36 is appropriate for continuously or occasionally removing the liquid which condenses and accumulates in the unit 30. If the gas entering the ejector 33 is undersaturated with water, a make-up feed via the line 35 serves to add liquid in the unit 30 and thereby preserve the requisite liquid volume of motive/auxiliary fluid.

The overall installation is cooled by ambient air or preferably by surrounding water (in the case of offshore or subsea production). Fins can be provided in the units 20, 30 to increase the heat exchange area and therefore the cooling efficiency.

The temperature of the compressed gas fraction is preferably selected as low in order to improve the compression efficiency and also reduce the losses of auxiliary liquid in vapor form in the compressed gas.

For this purpose, supplementary cooling may be provided by cooling the motive fluid or preferably the auxiliary fluid with ambient air, seawater, or cooling water, in order to stabilize or lower the operating temperature of the system.

The invention can be implemented to compress a production crude oil. This may be an oil containing gases and/or water, or it may be a gas mixture containing liquid condensates. In any case, the great safety of the system makes it ideally suited to the treatment of effluents with a high content of sour and/or corrosive and/or toxic gases, such as $H_2S$ (up to 40%) or $CO_2$ (up to 70%).

According to an alternative embodiment, the invention also serves to compress a "dry" gas (or gas mixture), containing no or practically no liquid condensates. This alternative embodiment is implemented by eliminating the first module and by preserving the second module. In this case, the gas is conveyed directly to the ejector 33, via the line 22. The various aspects of compression using a motive liquid and of gas/liquid separation occurring in the separator 34 and in the unit 30 remain unchanged from the above description. This embodiment is suitable not only for compressing gaseous hydrocarbons but also for compressing gases such as $H_2S$ or $CO_2$ from flue gases.

The invention claimed is:

1. A device for compressing a liquid/gas multiphase fluid, comprising:

at least one first module comprising:

a first liquid separation and compression unit;

at least one second module comprising:

a second liquid separation and compression unit;

an ejector;

a separator connected to the outlet of the ejector;

a motive liquid intake line connected to the inlet of the ejector;

a compressed gas fraction intake line and an auxiliary liquid intake line connected to the outlet of the separator;

at least one liquid/gas multiphase fluid intake line feeding the first module;

at least one compressed liquid fraction withdrawal line at the outlet of the first module;

at least one gas fraction withdrawal line connecting an outlet of the first liquid separation and compression unit of the first module to an inlet of the ejector of the second module; and at least one compressed gas fraction withdrawal line at the outlet of the second module.

2. The device as claimed in claim 1, in which the first liquid separation and compression unit and the second liquid separation and compression unit are vertical or inclined pipes.

3. The device as claimed in claim 1, in which the first liquid separation and compression unit and the second liquid separation and compression unit are dummy wells.

4. The device as claimed in claim 1, in which the first liquid separation and compression unit is equipped with submersible pumping means and the second liquid separation and compression unit is equipped with submersible pumping means.

5. The device as claimed in claim 4, in which the second submersible pumping means compress the auxiliary liquid into motive liquid.

6. The device as claimed in claim 1, in which the second module further comprises:

a second liquid separation and compression unit, connected to the inlet of the compressed gas fraction intake line and to the auxiliary liquid intake line, and connected to the outlet of the compressed gas fraction withdrawal line and to the motive liquid intake line.

7. The device as claimed in claim 1, in which the first module further comprises:

a first separator whereof the inlet is connected to a multiphase fluid intake line;

a gas pre-fraction intake line connecting an outlet of the first separator to an inlet of the first liquid separation and compression unit;

a liquid pre-fraction intake line connecting an outlet of the firs separator to an inlet of the first liquid separation and compression unit.

8. The device as claimed in claim 6, further comprising:

at an inlet of the second module, an auxiliary liquid reserve intake line connected to the inlet of the second liquid separation and compression unit; and from the second module to the first module, a transfer line connecting an outlet of the second liquid separation and compression unit to an inlet of the first liquid separation and compression unit.

9. The device as claimed in claim 1, in which a multiphase fluid intake line feeds a plurality of first modules and each of the first modules feeds a gas fraction to a plurality of second modules.

10. A gas compression device, comprising:

an ejector;

a gas feed line connected to the inlet of the ejector;

a separator connected to the outlet of the ejector;

a liquid separation and compression unit consisting of a dummy well;

a compressed gas intake line and an auxiliary liquid intake line connected to the outlet of the separator and to the inlet of the liquid separation and compression unit;

a compressed gas withdrawal line at the outlet of the liquid separation and compression unit; and a motive liquid intake line connected to the outlet of the liquid separation and compression unit and to the inlet of the ejector.

11. The device as claimed in claim 10, in which the liquid separation and compression unit is equipped with submersible pumping means.

12. The device as claimed in claim 11, in which the submersible pumping means compress the auxiliary liquid into motive liquid.

13. The device as claimed in claim 11, further comprising:

an auxiliary liquid reserve intake line connected to the inlet of the liquid separation and compression unit.

14. A device for producing pressurized hydrocarbons comprising:

a device as claimed in claim 1; and a hydrocarbon drilling/production installation supplying same.

* * * * *

UNITED STATES PATENT AND TRADEMARK OFFICE

CERTIFICATE OF CORRECTION

PATENT NO. : 8,025,100 B2
APPLICATION NO. : 11/688700
DATED : September 27, 2011
INVENTOR(S) : Pierre-Louis Dehaene and Jean-Louis Beauquin It is certified that error appears in the above-identified patent and that said Letters Patent is hereby corrected as shown below:

On the front page of the issued patents under OTHER PUBLICATIONS, delete "May 5, 2007" and insert therefore --May 25, 2007--.
At Col. 7, line 14, delete "separation"means" and insert therefore --separation" means--.

Signed and Sealed this
Eighth Day of November, 2011

David J. Kappos

David J. Kappos
*Director of the United States Patent and Trademark Office*